US009629406B2

(12) United States Patent
Kim et al.

(10) Patent No.: US 9,629,406 B2
(45) Date of Patent: Apr. 25, 2017

(54) PACKAGE FOR HAIR PRODUCTS

(71) Applicant: SHAKE-N-GO FASHION, INC., Port Washington, NY (US)

(72) Inventors: James K. Kim, Manhasset, NY (US); Peter Ough, Bayside, NY (US); Hye Sun Kim, Port Washington, NY (US)

(73) Assignee: Shake-N-Go Fashion, Inc., Port Washington, NY (US)

( * ) Notice: Subject to any disclaimer, the term of this patent is extended or adjusted under 35 U.S.C. 154(b) by 0 days.

(21) Appl. No.: 14/331,463

(22) Filed: Jul. 15, 2014

(65) Prior Publication Data

US 2015/0223536 A1 Aug. 13, 2015

Related U.S. Application Data

(60) Provisional application No. 61/937,706, filed on Feb. 10, 2014.

(51) Int. Cl.
*A41G 5/00* (2006.01)
*B65D 85/00* (2006.01)
(Continued)

(52) U.S. Cl.
CPC ..... *A41G 5/004* (2013.01); *B65D 73/0014* (2013.01); *B65D 75/321* (2013.01); *B65D 85/70* (2013.01)

(58) Field of Classification Search
CPC ..... A45D 44/005; B65D 2543/00555; B65D 5/5085
USPC ..... 132/53, 201, 208, 222, 223, 225; 206/8, 206/458, 457, 278, 471, 581, 823, 467, 206/4.21, 4.26, 4.27, 784, 388, 49; 434/94; 220/4.23, 670, 623, 608, 669, 220/4.21, 4.26, 4.27
See application file for complete search history.

(56) References Cited

U.S. PATENT DOCUMENTS 1,173,436 A 2/1916 Julicher
1,535,102 A 6/1924 Cohn
(Continued)

OTHER PUBLICATIONS

"Cuticle Remy XQ" product advertisement, Hype Hair, pp. 17-18 (Mar. 2012).

(Continued)

*Primary Examiner* — J. Gregory Pickett
*Assistant Examiner* — Allan Stevens
(74) *Attorney, Agent, or Firm* — Greenberg Traurig, LLP

(57) ABSTRACT

The present invention relates to a package for packaging a hair product having a plurality of hair strands which include curls. More particularly, the package includes first and second package sections engageable with one another for positioning the hair product therebetween. The first package section includes at least one first portion having a first curved shape, while the second package section includes at least one second portion having a second curved shape which substantially corresponds to the first curved shape. When the first and second package sections are engaged with one another, the at least one first curved portion and the at least one second curved portion are positioned in close proximity with one another so as to contain at least one set of the curls of the hair product therebetween for maintaining the shapes of the at least one set of the curls of the hair product.

8 Claims, 5 Drawing Sheets

(51) Int. Cl.
*B65D 73/00* (2006.01)
*B65D 75/32* (2006.01)

(56) References Cited

U.S. PATENT DOCUMENTS

| | | | | | |
|---|---|---|---|---|---|
| 1,585,417 | A | | 5/1926 | Robinson | |
| 1,636,967 | A | | 7/1927 | Perry | |
| 2,191,571 | A | | 10/1937 | Lirette | |
| 2,868,371 | A | | 7/1957 | Thorpe | |
| 3,837,476 | A | * | 9/1974 | Schwartz | 206/45.24 |
| 4,201,289 | A | * | 5/1980 | Mack et al. | 206/0.5 |
| 4,216,787 | A | | 8/1980 | Moea | |
| 4,453,629 | A | * | 6/1984 | Goldberg | B65D 75/322 206/445 |
| 4,739,776 | A | | 4/1988 | Prijic | |
| 2,375,087 | A | | 5/1994 | De Bruin | |
| 5,312,015 | A | | 5/1994 | Gelzer | |
| 5,413,214 | A | | 5/1995 | Schonke | |
| 5,485,919 | A | * | 1/1996 | Samberg et al. | 206/461 |
| 5,816,408 | A | | 10/1998 | Indelicato | |
| 7,556,152 | B2 | | 7/2009 | Lechelle | |
| 7,886,905 | B2 | | 2/2011 | Kamada | |
| 8,025,065 | B2 | * | 9/2011 | Guliker | 132/201 |
| 8,439,237 | B2 | | 5/2013 | Choi | |
| 8,590,543 | B2 | | 11/2013 | Goff et al. | |
| 9,044,077 | B1 | | 6/2015 | Lin | |
| 9,259,044 | B2 | | 2/2016 | Kim et al. | |
| 2003/0159962 | A1 | | 8/2003 | Heo | |
| 2004/0226858 | A1 | | 11/2004 | Jhung | |
| 2007/0199833 | A1 | * | 8/2007 | Hunt | A45C 11/02 206/8 |
| 2011/0284397 | A1 | | 11/2011 | Batres et al. | |
| 2012/0006696 | A1 | | 1/2012 | Choi | |
| 2012/0111742 | A1 | | 5/2012 | Choi | |

OTHER PUBLICATIONS

"Cuticle Remy XQ" product advertisement, Sophisticate's Black Hair, pp. 6-7 (May 2012).

* cited by examiner

PACKAGE FOR HAIR PRODUCTS

CROSS-REFERENCE TO RELATED APPLICATION

This application claims priority to U.S. Patent Application No. 61/937,706 filed Feb. 10, 2014, the disclosure of which is incorporated herein by reference in its entirety.

FIELD OF THE INVENTION

The present invention relates to packages for hair products and, more particularly, to a package adapted for maintaining the shapes of curls provided in hair strands, such as in a hair extension product.

BACKGROUND OF THE INVENTION

Hair products, such as hair extensions and wigs, have been provided in packages. Some hair products are provided with curls or waves in hair strands. The present invention provides a package for maintaining the shapes of such curls.

SUMMARY OF THE INVENTION

In accordance with an embodiment of the present invention, a package is provided for packaging a hair product having a plurality of hair strands which include curls. More particularly, the package includes first and second package sections engageable with one another for positioning the hair product therebetween. The first package section includes at least one first portion having a first curved shape, while the second package section includes at least one second portion having a second curved shape which substantially corresponds to the first curved shape. When the first and second package sections are engaged with one another, the at least one first curved portion and the at least one second curved portion are positioned in close proximity with one another so as to contain at least one set of the curls of the hair product therebetween for maintaining the shapes of the at least one set of the curls of the hair product.

In accordance with one embodiment, the at least one first curved portion of the first package section has a first sinusoidal profile, while the at least one second curved portion of the second package section has a second sinusoidal profile, which substantially corresponds, in shape, to the first sinusoidal profile. In accordance with another embodiment, the at least one first curved portion of the first package section includes at least one first concave portion and at least one first convex portion connected to the at least one first concave portion, while the at least one second curved portion of the second package section includes at least one second concave portion and at least one second convex portion connected to the at least one second concave portion. The at least one first concave portion and the at least one second concave portion cooperate with one another so as to contain at least one first set of the curls of the hair product therebetween for maintaining the shapes of the at least one first set of the curls of the hair product. Similarly, the at least first convex portion and the at least one second convex portion cooperate with one another so as to contain at least one second set of the curls of the hair product therebetween for maintaining the shapes of the at least one second set of the curls of the hair product. Each of the at least one first concave portion and the at least one first convex portion extends in a first direction substantially perpendicular to a first longitudinal axis of the first package section, while each of the at least one second concave portion and the at least one second convex portion extends in a second direction substantially perpendicular to a second longitudinal axis of the second package section. The first longitudinal axis of the first package section is substantially parallel to the second longitudinal axis of the second package section when the first and second package sections are removably attached to one another. The at least one first concave portion and the at least one first convex portion are also arranged along the first longitudinal axis of the first package section, while the at least one second concave portion and the at least one second convex portion are arranged along the second longitudinal axis of the second package section.

BRIEF DESCRIPTION OF THE DRAWINGS

For a more complete understanding of the present invention, reference is made to the following detailed description of exemplary embodiments considered in conjunction with the accompanying drawings, in which.

DETAILED DESCRIPTION OF EMBODIMENTS OF THE INVENTION

Figure 1:
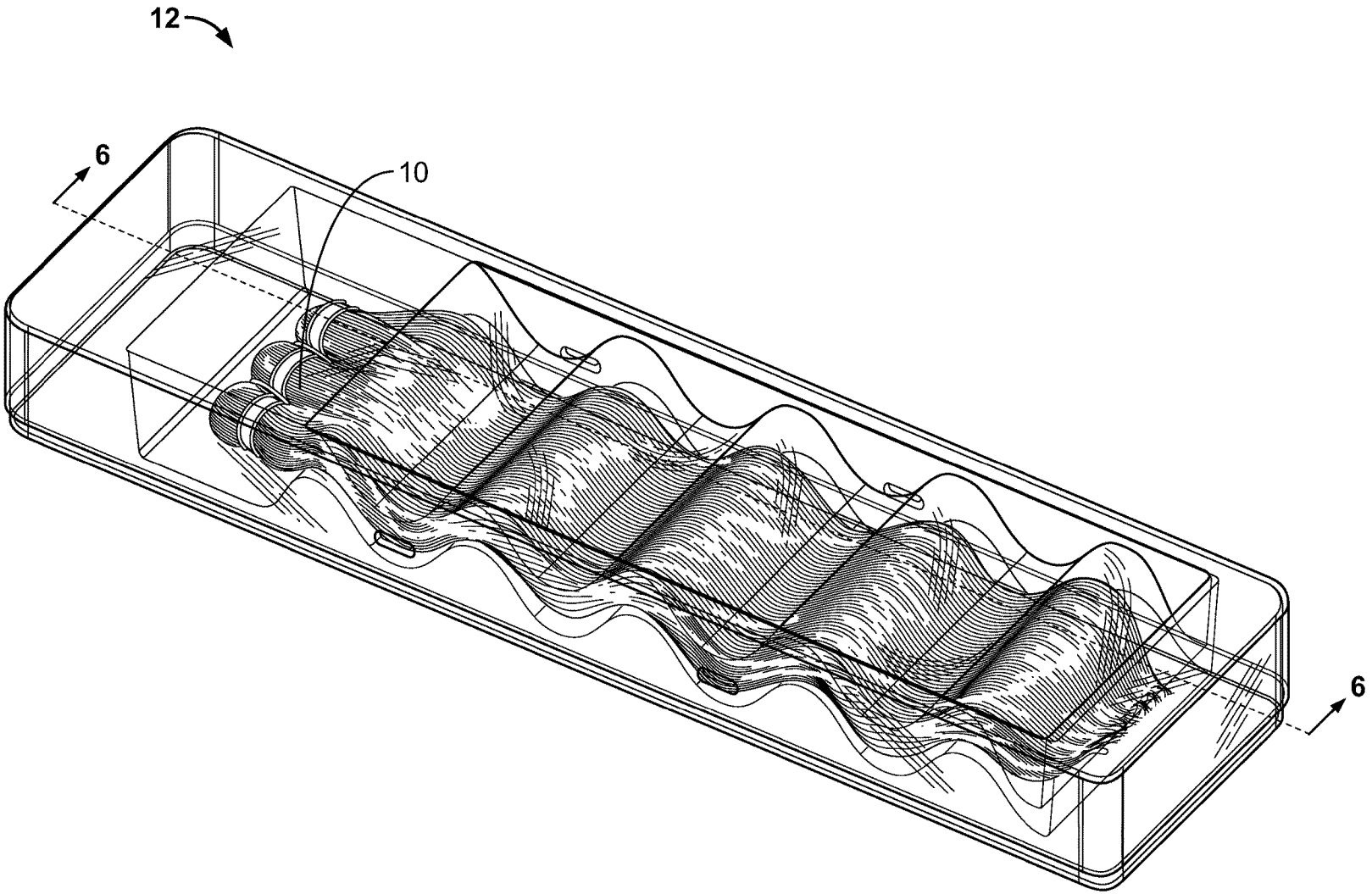
FIG. 1 is a perspective view of a package constructed in accordance with an embodiment of the present invention for packaging a hair extension product therein.

Various embodiments are disclosed herein; however, it is to be understood that the disclosed embodiments are merely illustrative of the disclosure that can be embodied in various forms. In addition, each of the examples given in connection with the various embodiments is intended to be illustrative, and not restrictive. Further, the figures are not necessarily to scale, some features may be exaggerated to show details of particular components (and any size, material and similar details shown in the figures are intended to be illustrative and not restrictive). Therefore, specific structural and functional details disclosed herein are not to be interpreted as limiting, but merely as a representative basis for teaching one skilled in the art to variously employ the disclosed embodiments.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; exemplary embodiments are provided merely to be illustrative. Among other things, for example, subject matter may be embodied as methods, devices, components, combinations or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Moreover, directional and positional phrases, such as "upper", "lower", "lateral", "bottom", "top", "front", "rear", "downwardly", "upwardly", "laterally", "axially", etc., are used herein for illustration purposes only and should not be construed as limiting the scope of the present invention.

Although the present invention can be used in conjunction with any type of hair products, it is particularly suitable for use in connection with a hair extension product. Accordingly, the present invention will be described hereinafter in connection with such a hair product. It should be understood, however, that the following description is only meant to be illustrative of the present invention and is not meant to limit the scope of the present invention, which has applicability to other hair product types, including wigs and other hairpieces.

Figure 2:
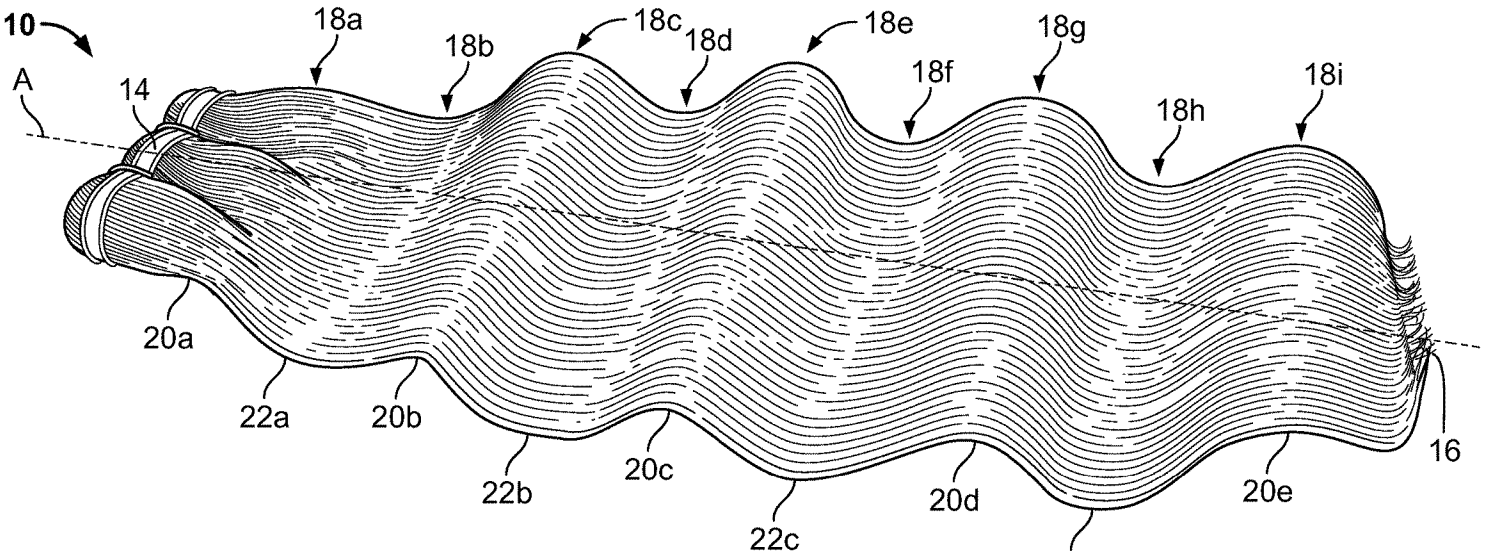
FIG. 2 is a perspective view of the hair extension product shown in FIG. 1.
Figure 3:
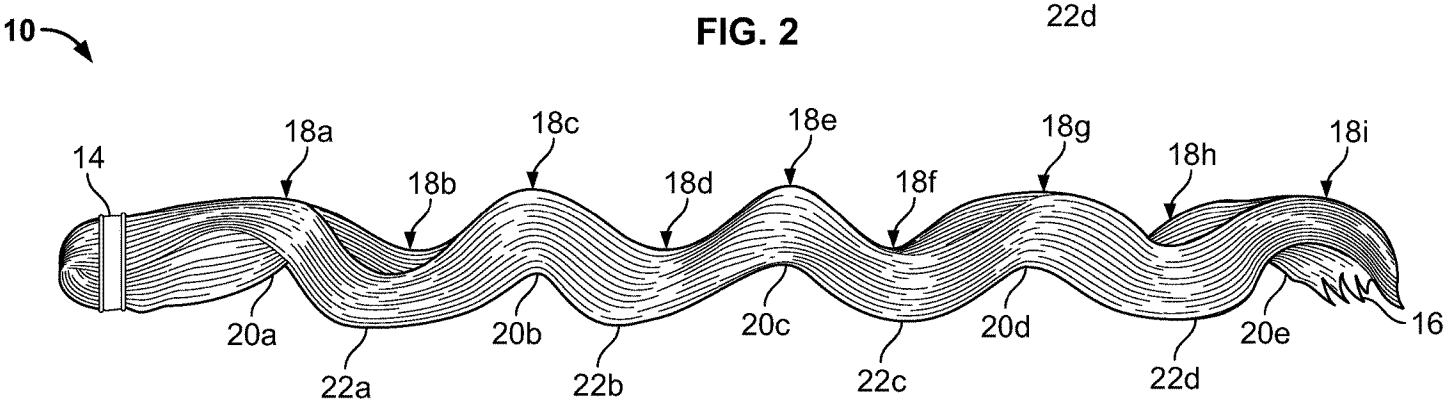
FIG. 3 is a side view of the hair extension product shown in FIG. 1.

With reference to FIGS. 1-3, a hair extension product 10 is packaged in a package 12 in accordance with an embodiment of the present invention. The hair extension product 10 is constructed and assembled in basically the same manner as conventional hair extension products (such as the hair extension product sold by Shake-N-Go Fashion, Inc., Port Washington, N.Y., under the trademark XQ® SENSUOUS WAVE). For instance, the hair extension product 10 includes a weft track or band 14, and a plurality of hair strands 16 attached to and depending from the weft track 14 and extending generally along an axial direction (i.e., in a direction generally parallel to a longitudinal axis A of the hair extension product 10, as shown in FIG. 2). The hair strands 16 are provided with a plurality of curls 18*a*-18*i*, each of which extends generally in a lateral direction generally perpendicular to the axial direction (i.e., generally perpendicular to the longitudinal axis A of the hair extension product 10). The hair extension product 10 are illustrated in the accompanying drawings with the weft track 14 folded upon itself and the hair strands 16 laid on top of each other. When viewed laterally from a side of the hair extension product 10 (see FIG. 3), the curls 18*a*, 18*c*, 18*e*, 18*g*, 18*i* form peaks 20*a*-20*e*, respectively, while the curls 18*b*, 18*d*, 18*f*, 18*h* form valleys 22*a*-22*d*, respectively. The peaks 20*a*-20*e* and the valleys 22*a*-22*d* cooperate to define continuously extending waves. The curls 18*a*-18*i* are formed in a spaced manner such that each of them is spaced from an adjacent one or set of the curls 18*a*-18*i* by a predetermined distance.

Figure 4:
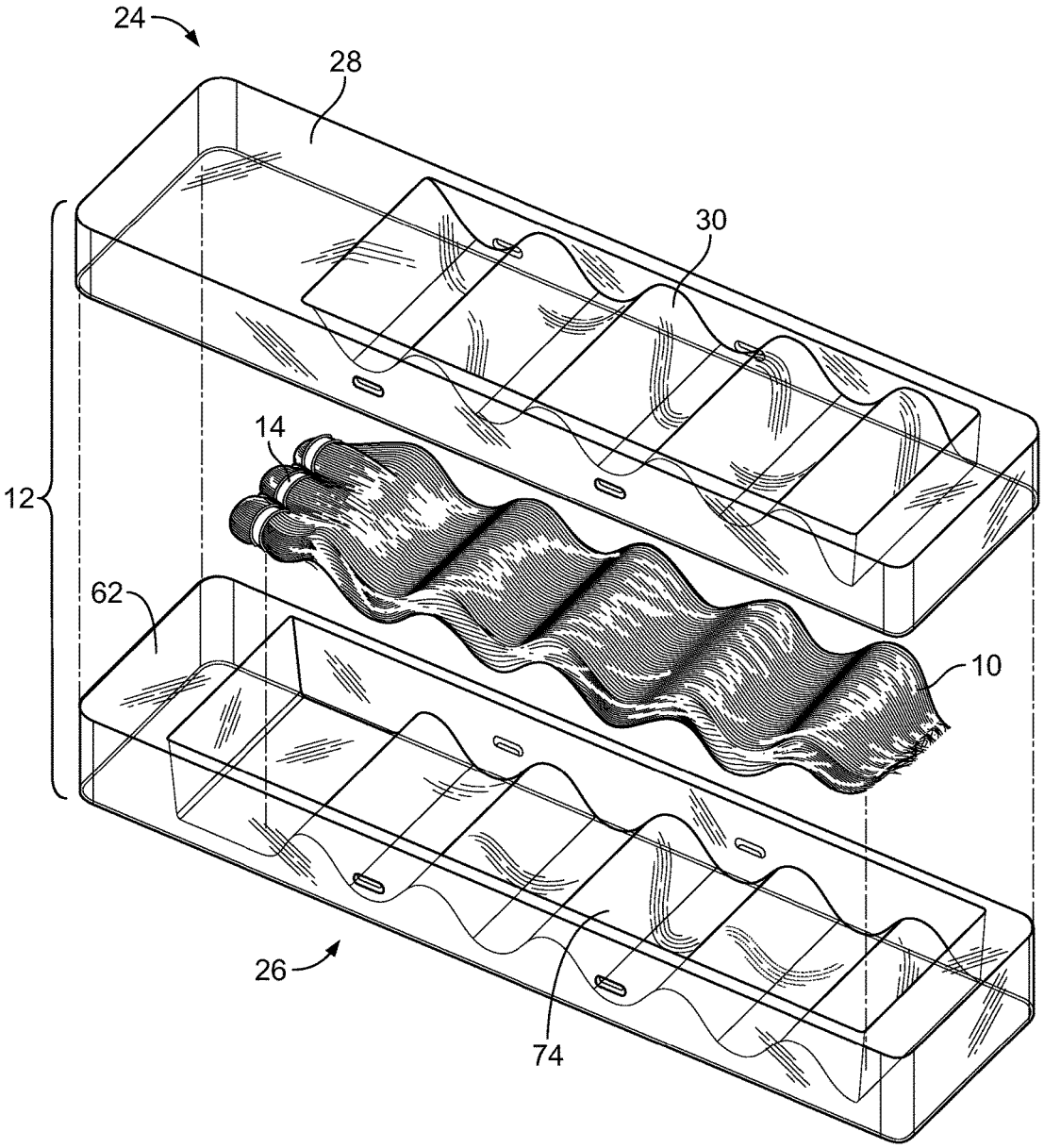
FIG. 4 is an exploded, perspective view of the package shown in FIG. 1.
Figure 5:
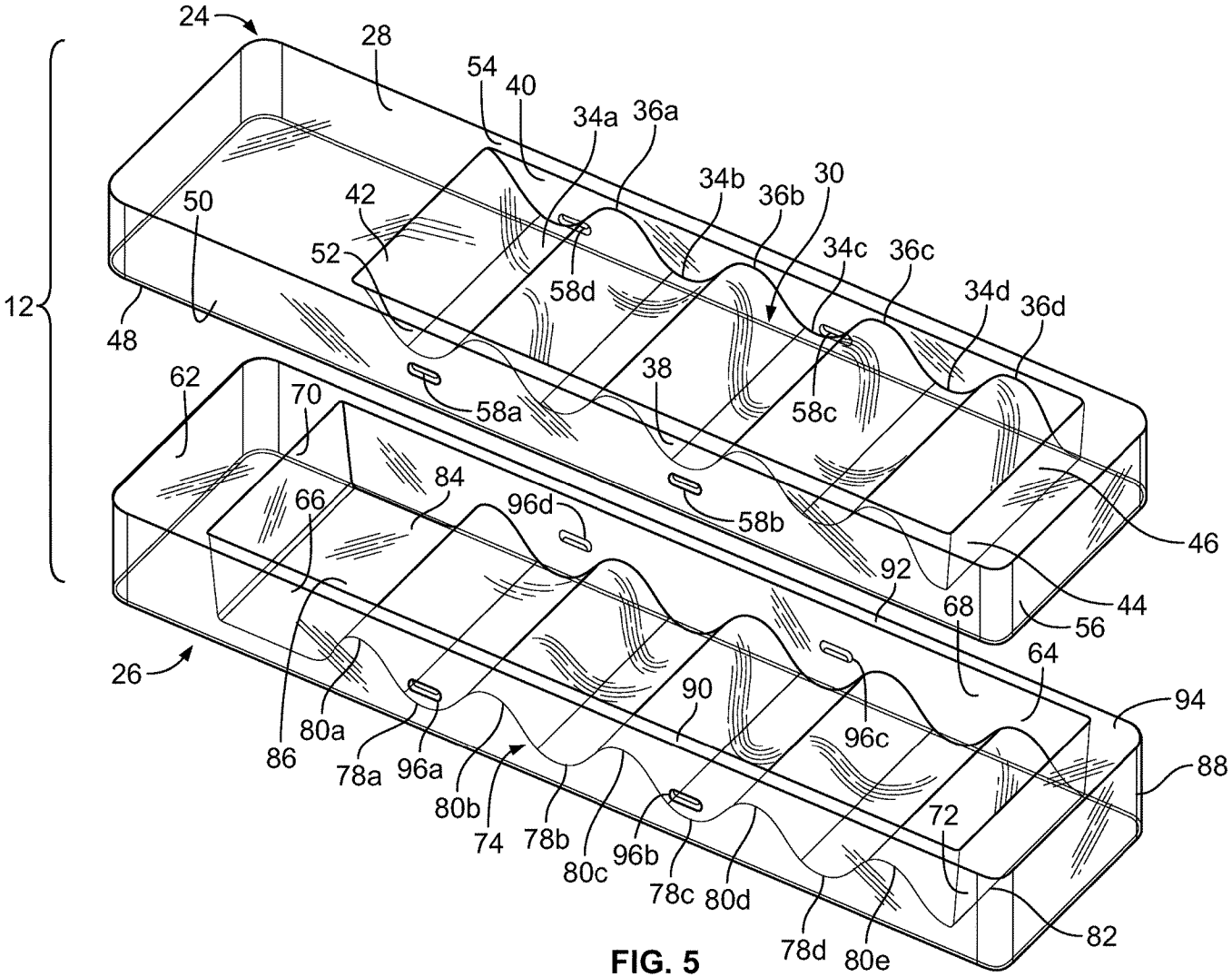
FIG. 5 is a view similar to FIG. 4, except that the hair extension product is not shown in FIG. 5.

Referring to FIGS. 4 and 5, the package 12 includes upper and lower package sections 24, 26 which are engageable with one another for receiving, containing or positioning the hair extension product 10 therebetween. More particularly, the upper package section 24 includes an upper wall 28 having a curved plate 30 formed therewith. The curved plate 30 has a generally sinusoidal profile 32 (see FIG. 6) so as to maintain the shapes of the curls 18*a*-18*i* of the hair extension product 10 when it is packaged in the package 12. In this regard, the sinusoidal profile 32 includes a plurality of concave portions (i.e., valleys) 34*a*-34*d* and a plurality of convex portions (i.e., peaks) 36*a*-36*d* when viewed from the side (see, e.g., FIG. 6). Each of the concave portions 34*a*-34*d* projects downwardly from the upper wall 28, while each of the convex portions 36*a*-36*d* projects upwardly from an adjacent one of the concave portions 34*a*-34*d*. The concave and convex portions 34*a*-34*d*, 36*a*-36*d* of the curved plate 30 define the curvature of the sinusoidal profile 32, which generally or substantially corresponds to the shapes of the curls 18*a*-18*i* of the hair extension product 10.

The upper package section 24 also includes side plates 38, 40 depending from the upper wall 28 and connected to opposing lateral sides of the concave and convex portions 34*a*-34*d*, 36*a*-36*d* (see, e.g., FIG. 5). Moreover, one end 42 of the curved plate 30 is connected to the upper wall 28, while an opposite end 44 of the curved plate 30 is connected to an end plate 46, which depends from the upper wall 28 (see, e.g., FIG. 5). In this manner, the side plates 38, 40 and the end plate 46 cooperate to stabilize the sinusoidal profile 32 of the curved plate 30 (e.g., the curved plate 30 is inhibited from moving vertically).

The upper package section 24 also includes an annular skirt 48 (see FIG. 5) depending from an outer periphery of the upper wall 28. The skirt 48 and the upper wall 28 cooperate to define a space 50 for receiving the lower package section 26. The skirt 48 and the side plates 38, 40 cooperate to define side channels 52, 54, respectively (see FIG. 5), while the skirt 48 and the end plate 46 cooperate to define an end channel 56 (see FIG. 5). Detents 58*a*-58*d* project laterally inwardly from the skirt 48 for purposes to be discussed hereinbelow.

Now referring to FIGS. 4 and 5, the lower package section 26 includes an upper wall 62 having an opening 64 therein. Side plates 66, 68 and end plates 70, 72 depend from the upper wall 62 so as to define the opening 64. The lower package section 26 is also provided with a curved plate 74 having a sinusoidal profile 76 (see FIG. 6) which substantially corresponds to the sinusoidal profile 32 of the upper package section 24 for maintaining the shapes of the curls 18*a*-18*i* of the hair extension product 10 when it is packaged in the package 12. More particularly, the sinusoidal profile 74 includes a plurality of concave portions (i.e., valleys) 78*a*-78*d* and a plurality of convex portions (i.e., peaks) 80*a*-80*e*. Each of the concave portions 78*a*-78*d*, which project downwardly, is shaped so as to substantially conform to the shape of a corresponding one of the concave portions 34*a*-34*d*. Similarly, each of the convex portions 80*b*-80*e*, which project upwardly, is shaped so as to substantially conform to the shape of a corresponding one of the convex portions 36*a*-36*d*. The curved plate 74 also has an end 82 attached to the end plate 72 and includes a substantially planar section 84 connected to the end plate 70 for defining an enlarge opening area 86 which is part of the opening 64 of the lower package section 26 (see also FIG. 6).

Still referring to FIGS. 4 and 5, the lower package section 26 is also provided with an annular skirt 88 depending from the upper wall 62. The skirt 88 and the side plates 66, 68 cooperate to form side sections 90, 92, respectively, sized and shaped so as to be received in the side channels 52, 54, respectively, of the upper package section 24. Similarly the skirt 88 and the end plate 72 cooperate to form an end section 94 (see also FIG. 6) sized and shaped so as to be received in the end channel 56 of the upper package section 24. The skirt 88 also includes a plurality of depressions 96*a*-96*d* which are sized and shaped so as to receive the detents 58*a*-58*d*, respectively, of the upper package section 24 for releasably securing the lower package section 26 to the upper package section 24.

Each of the upper and lower package sections 24, 26 can be made from any material that is sufficiently rigid to maintain the shapes of the curls 18*a*-18*i* of the hair extension product 10 captured between the upper and lower package sections 24, 26. For instance, each of the upper and lower package sections 24, 26 can be made from plastic, vinyl, paper, metal, etc. In one embodiment, the upper and lower package sections 24, 26 can be made as blister packs in any conventional manner. In another embodiment, the upper and lower package sections 24, 26 are made from a transparent or translucent material such that the hair extension product 10 can be viewed therethrough. In a further embodiment, the upper and lower package sections 24, 26 can be made from an opaque material. In yet another embodiment, each of the upper and lower package sections 24, 26 has a monolithic construction. Moreover, the upper and lower package sections 24, 26 are sized and shaped so as to contain the hair extension product 10 entirely within the package 12.

Figure 6:
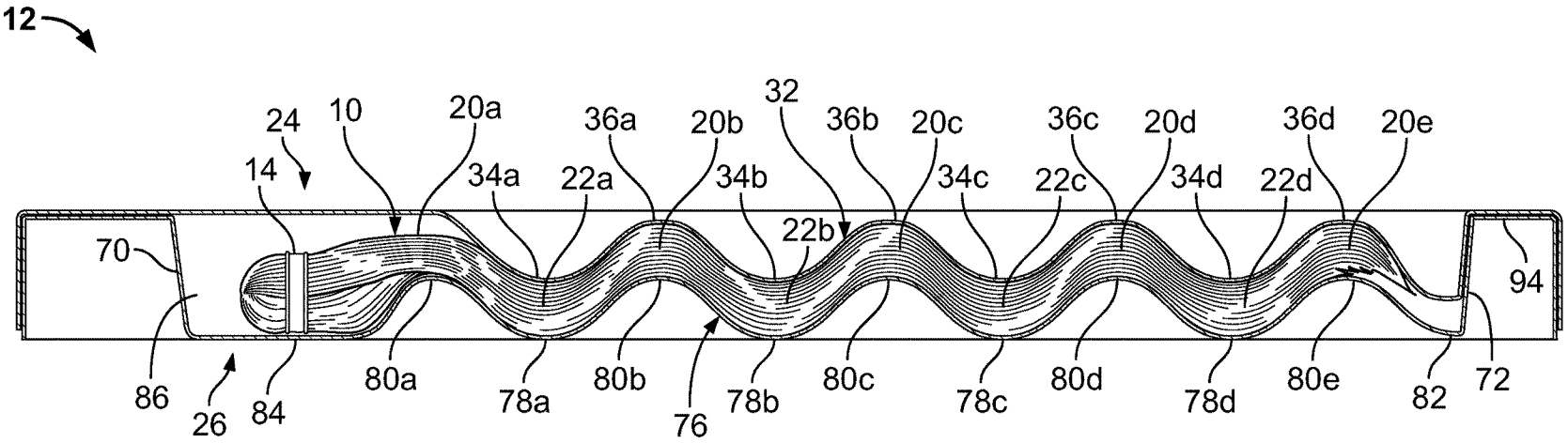
FIG. 6 is a cross-sectional view, taken along section line 6-6 and looking in the direction of the arrows, of the package shown in FIG. 1.

Now referring to FIGS. 1 and 6, the hair extension product 10 is packaged in the package 12 in accordance with an embodiment of the present invention. The hair extension product 10 is placed in the opening 64 of the lower package section 26 over the curved plate 74. More particularly, the hair extension product 10 is positioned such that the portion adjacent the weft track 14 is positioned in the enlarged opening area 86 over the planar section 84 of the curved plate 74. Further, the peaks 20*a*-20*e* of the hair extension product 10 are placed over the convex portions 80*a*-80*e*, respectively, of the curved plate 74, while the valleys 22*a*-22*d* of the hair extension product 10 are placed over the concave portions 78*a*-78*d*, respectively, of the curved plate 74.

After the hair extension product 10 is placed in the lower package section 26, the upper package section 24 is placed on top of the lower package section 26 so as to capture the hair extension product 10 therebetween. In this regard, the detents 58*a*-58*d* are snapped into the depressions 96*a*-96*d*, respectively, so as to releasably secure the upper package section 24 to the lower package section 26. Once the upper package section 24 is properly applied to the lower package section 26, the concave portions 34*a*-34*d* and the convex portions 36*a*-36*d* of the curved plate 30 of the upper package section 24 are aligned with (i.e., placed over) the concave portions 78*a*-78*d* and the convex portions 80*b*-80*e*, respectively, of the curved plate 74 of the lower package section 26 such that the curls 18*a*-18*i* of the hair extension product 10 are captured therebetween (see FIGS. 1 and 6). Because the sinusoidal profiles 32, 76 of the upper and lower package sections 24, 26, respectively, correspond to the shapes of the curls 18*a*-18*i*, the upper and lower package sections 24, 26 cooperate with one another so as to maintain the original curl shapes of the hair extension product 10.

It should be noted that the present invention has numerous variations and modifications. For instance, the sizes and/or the shapes of the sinusoidal profiles 32, 76 of the upper and lower package sections 24, 26 of the package 12 can be changed in a variety of ways to accommodate hair products having differently shaped curls and/or a different number of curls. Further the package 12 can be modified to accommodate different types of hair products, such as wigs, hair pieces, etc. Moreover, the detents 58*a*-58*d* and the depressions 96*a*-96*d* can be replaced and/or supplemented with other attaching mechanisms for removably attaching the upper package section 24 to the lower package section 26. In addition, the upper and lower package sections 24, 26 can be formed as a single piece (e.g., they are pivotally connected to each other). In one embodiment, the package 12 containing the hair product 10 is inserted into an outer package.

While the apparatus and method have been described in terms of one or more embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

We claim:

1. In combination, a hair product having a plurality of hair strands which include curls; and a package including first and second package sections engaged with one another and containing said hair product therebetween, said first package section including a first annular skirt, a first upper surface, a plurality of first vertically oriented walls, each of which depends from said first upper surface, and a first bottom wall, which is connected to and surrounded by said first vertically oriented walls, at least one opposing pair of said first vertically oriented walls being positioned within said first skirt so as to form a pair of side sections, said first vertically oriented walls and said first bottom wall defining a compartment recessed below said first upper surface and receiving said hair product therein, said first bottom wall defining a bottom of said compartment and including a plurality of first convex portions and a plurality of first concave portions which are positioned in an alternating fashion along a longitudinal axis of said first package section such that each of said first convex portions is adjacent at least one of said first concave portions, each of said first convex portions and said first concave portions spanning between said at least one opposing pair of said first vertically oriented walls, said second package section including a second annular skirt, a plurality of second vertically oriented walls and a second bottom wall, at least one opposing pair of said second vertically oriented walls being positioned within said second annular skirt so as to define a pair of side channels, each of said side sections being received in a corresponding one of said side channels, said second bottom wall including a plurality of second convex portions and a plurality of second concave portions which are positioned in an alternating fashion along a longitudinal axis of said second package section such that each of said second convex portions is adjacent at least one of said second concave portions, each of said second convex portions and said second concave portions spanning between said at least one opposing pair of said second vertically oriented walls, said second convex portions and said second concave portions being positioned within said compartment, each of said second convex portions and each of said second concave portions being aligned with a corresponding one of said first concave portions and a corresponding one of said first convex portions, respectively, so as to contain at least one set of said curls therebetween for maintaining the shapes of said at least one set of said curls.

2. The combination of claim 1, wherein each of said first concave portions and said first convex portions extends in a first direction substantially perpendicular to said longitudinal axis of said first package section; and wherein each of said second concave portions and said second convex portions extends in a second direction substantially perpendicular to said longitudinal axis of said second package section, said longitudinal axis of said first package section being substantially parallel to said longitudinal axis of said second package section.

3. The combination of claim 1, wherein said first convex portions and said first concave portions are arranged along said longitudinal axis of said first package section and forming a first sinusoidal profile; and wherein said second convex portions and said second concave portions are arranged along said longitudinal axis of said second package section and forming a second sinusoidal profile which substantially corresponds, in shape, to said first sinusoidal profile.

4. The combination of claim 1, wherein said first package section is elongated along said longitudinal axis thereof; and wherein said second package section is elongated along said longitudinal axis thereof.

5. The combination of claim 4, wherein each of said first convex portions and said first concave portions extends in a first direction substantially perpendicular to said first longitudinal axis of said first package section; and wherein each of said second convex portions and said second concave portions extends in a second direction substantially perpendicular to said longitudinal axis of said second package section.

6. The combination of claim 1, wherein each of said first and second package sections has a monolithic construction.

7. The combination of claim 1, wherein said hair product is housed entirely within said first and second package sections.

8. The combination of claim 7, wherein each of said first and second package sections has a monolithic construction.

* * * * *